US007421985B2

(12) United States Patent
Fujimoto et al.

(10) Patent No.: US 7,421,985 B2
(45) Date of Patent: Sep. 9, 2008

(54) WATER-COOLED INTERNAL COMBUSTION ENGINE

(75) Inventors: Yasushi Fujimoto, Saitama (JP); Katsuhiko Ito, Saitama (JP); Kinya Mizuno, Saitama (JP); Masako Takahashi, Saitama (JP); Hiromi Sumi, Saitama (JP); Hiroshi Sotani, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 127 days.

(21) Appl. No.: 11/589,199

(22) Filed: Oct. 30, 2006

(65) Prior Publication Data

US 2007/0095306 A1 May 3, 2007

(30) Foreign Application Priority Data

Nov. 2, 2005 (JP) ..... 2005-319764
Feb. 17, 2006 (JP) ..... 2006-040673

(51) Int. Cl.
*F01P 5/10* (2006.01)
*F02B 77/00* (2006.01)

(52) U.S. Cl. ..... 123/41.44; 123/195 C; 123/198 E

(58) Field of Classification Search ... 123/41.44–41.47, 123/195 C, 198 E, 198 C
See application file for complete search history.

(56) References Cited

U.S. PATENT DOCUMENTS 2,852,009 A * 9/1958 Turlay ..... 123/41.1

FOREIGN PATENT DOCUMENTS

JP 2004-36584 A 2/2004

* cited by examiner

*Primary Examiner*—Noah Kamen
(74) *Attorney, Agent, or Firm*—Birch, Stewart, Kolasch & Birch, LLP

(57) ABSTRACT

A water-cooled internal combustion engine configured so as to facilitate the change of the cooling system, thereby reducing costs. The crankcase of the water-cooled internal combustion engine is adapted to journal a crankshaft. The crankcase is covered by a crankcase cover from the axial outside. The crankcase is connected to the crankcase cover through an annular shaped spacer, and at least part of a water pump is formed integrally with the spacer.

20 Claims, 13 Drawing Sheets

Figure 8
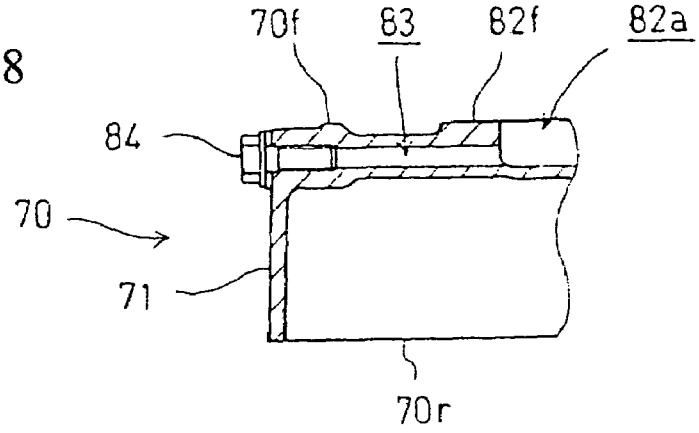
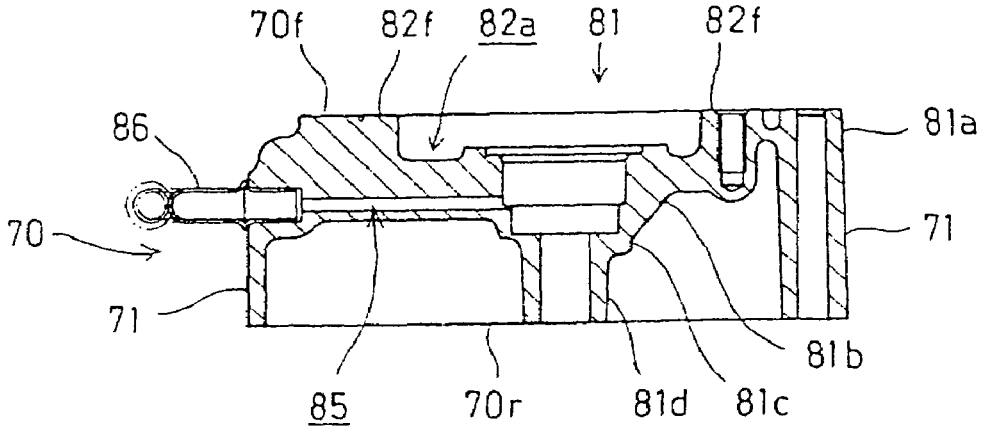
Figure 9

WATER-COOLED INTERNAL COMBUSTION ENGINE

CROSS-REFERENCE TO RELATED APPLICATION

The present application claims priority under 35 U.S.C. §119 to Japanese Patent Application No. 2005-319764, filed Nov. 2, 2005, and Japanese Patent Application No. 2006-040673, filed Feb. 17, 2006, the entire contents of which are hereby incorporated by reference.

BACKGROUND OF THE INVENTION

1. Field of the Invention

The present invention relates to a water-cooled internal combustion engine.

2. Description of Background Art

As described in e.g. Japanese Patent Laid-open No. 2004-036584, a water pump for circulating cooling water in a water-cooled internal combustion engine is mounted to a crankcase cover or the like.

The water pump described in Japanese Patent Laid-open No. 2004-036584 is configured such that a pump drive shaft parallel to a crankshaft is journaled by a pump body formed to be included in a crankcase cover and rotation of the crankshaft is transmitted to the pump drive shaft via a chain.

Thus, if the main body of then internal combustion engine is applied to an air-cooled engine, the crankcase cover should be replaced. In addition, the crankcase cover, which is a large-sized component with a various functions, cannot be shared even by the air-cooled engines with the result that the change of the cooling system becomes ambitious to thereby increase costs.

Incidentally, a water pump is mounted to a crankcase in some cases; however, it is difficult to replace the crankcase particularly. The change of a cooling system becomes increasingly ambitious to thereby further increase the costs.

SUMMARY AND OBJECTS OF THE INVENTION

The present invention has been made in view of the foregoing and it is an object of the invention to provide a water-cooled internal combustion engine that can facilitate the change of the cooling system to thereby reduce costs.

In order to achieve the above object, according to a first aspect of the present invention, in a water-cooled internal combustion engine in which a crankcase adapted to journal a crankshaft is covered by a crankcase cover from the axial outside, the crankcase is connected to the crankcase cover through a spacer, and at least part of a water pump is formed integrally with the spacer.

According to a second aspect of the present invention, a water pump body of the water pump is formed to be included in the spacer and a water pump cover is attached to the water pump body.

According to a third aspect of the present invention, a drain passage of the water pump is formed integrally with the spacer.

According to a forth aspect of the present invention, the water pump is disposed in the vicinity of an outer circumference of the spacer and the drain passage is formed to connect the water pump with an outer side surface of the spacer.

According to a fifth aspect of the present invention, a breather passage of the water pump is formed integrally with the spacer.

According to a sixth aspect of the present invention, the breather passage is formed to connect the water pump with an outer side surface of the spacer.

EFFECTS OF THE INVENTION

According to the first aspect of the present invention, the crankcase is connected to the crankcase cover through a spacer, and at least part of a water pump is formed integrally with the spacer; therefore, only by replacing a simply structured spacer without replacement of the conventional water pump and an engine cover such as a large-sized crankcase cover having various functions or the like, the engine cover can be shared also by an air-cooled internal combustion engine. This makes it simple to change the cooling system, thereby reducing costs.

According to the second aspect of the present invention, since a water pump body of the water pump is formed to be included in the spacer and a water pump cover is attached to the water pump body, even for a relatively large-sized water pump, the water pump body separate from the water pump cover is formed to be included in the spacer, thereby downsizing the spacer to facilitate its replacement.

According to the third aspect of the present invention, since a drain passage of the water pump is formed integrally with the spacer, it is not necessary to provide an additional pipe adapted to discharge water leaking from the water pump to the outside. This can reduce the number of part components to improve assembly performance and enhance the durability of drainage.

According to the fourth aspect of the present invention, the water pump is disposed in the vicinity of the outer circumference of the spacer and the drain passage is formed to connect the water pump with an outer side surface of the spacer; therefore, the drain passage can be reduced in length and a space inside the spacer can be utilized effectively.

According to the fifth aspect of the present invention, since a breather passage of the water pump is formed integrally with the spacer, it is not necessary to additionally provide a vent tube adapted to vent air from the water pump to the outside. This can reduce the number of part components to thereby provide satisfactory assembly performance and enhance the durability of the breather.

According to the sixth aspect of the present invention, since the breather passage is formed to connect the water pump with an outer side surface of the spacer, it can be reduced in length and a space inside the spacer can be utilized effectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 is a cross-sectional view of the spacer taken along line VIII-VIII of FIG. 6;

FIG. 9 is a cross-sectional view of the spacer taken along line IX-IX of FIG. 6;

DETAILED DESCRIPTION OF THE PREFERRED EMBODIMENTS

An embodiment of the present invention will be hereunder described with reference to FIGS. 1 through 16.

Figure 1:
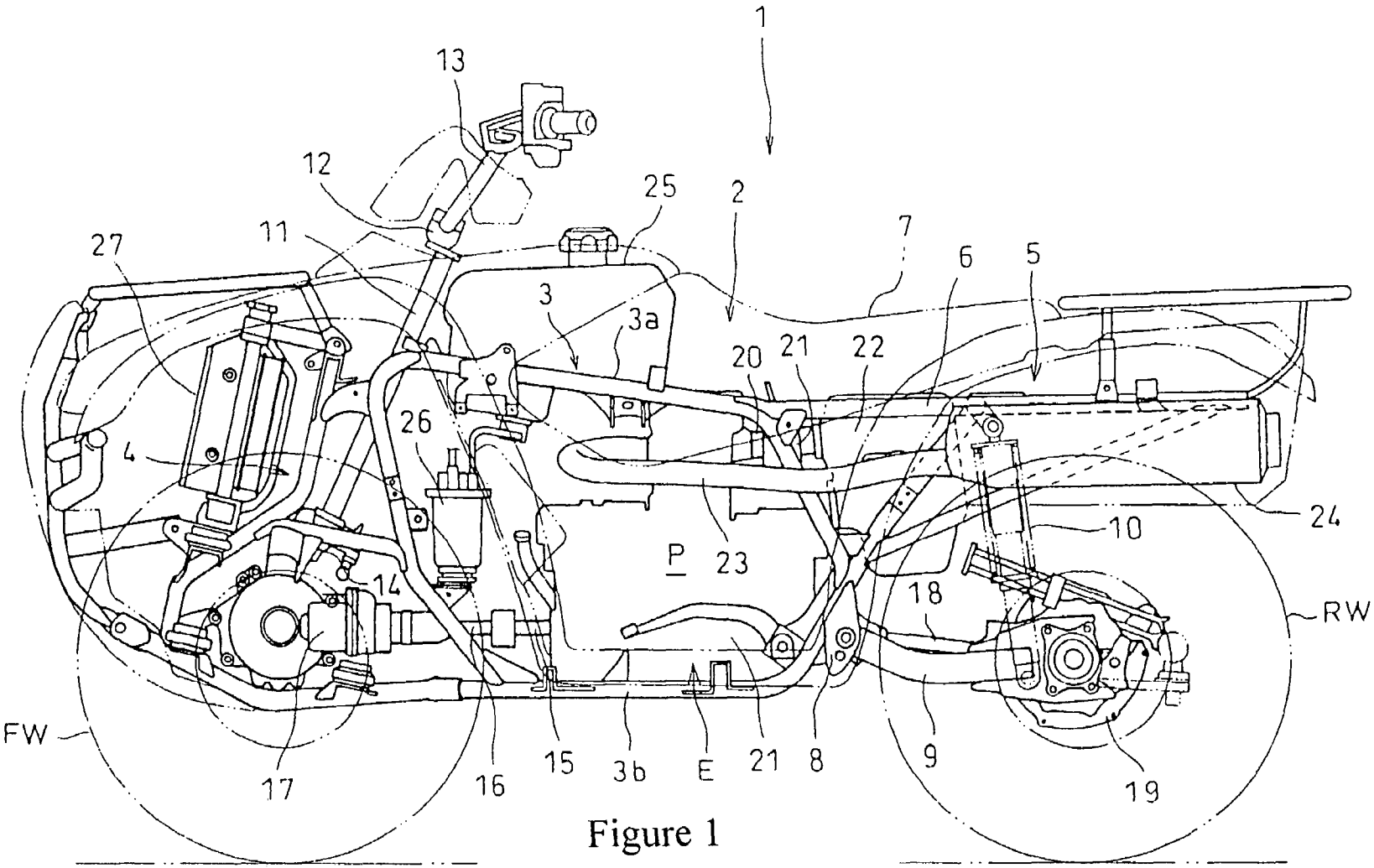
FIG. 1 is a side view of an all terrain vehicle, with a body cover removed, on which a water-cooled internal combustion engine according to an embodiment of the present invention.
Figure 2:
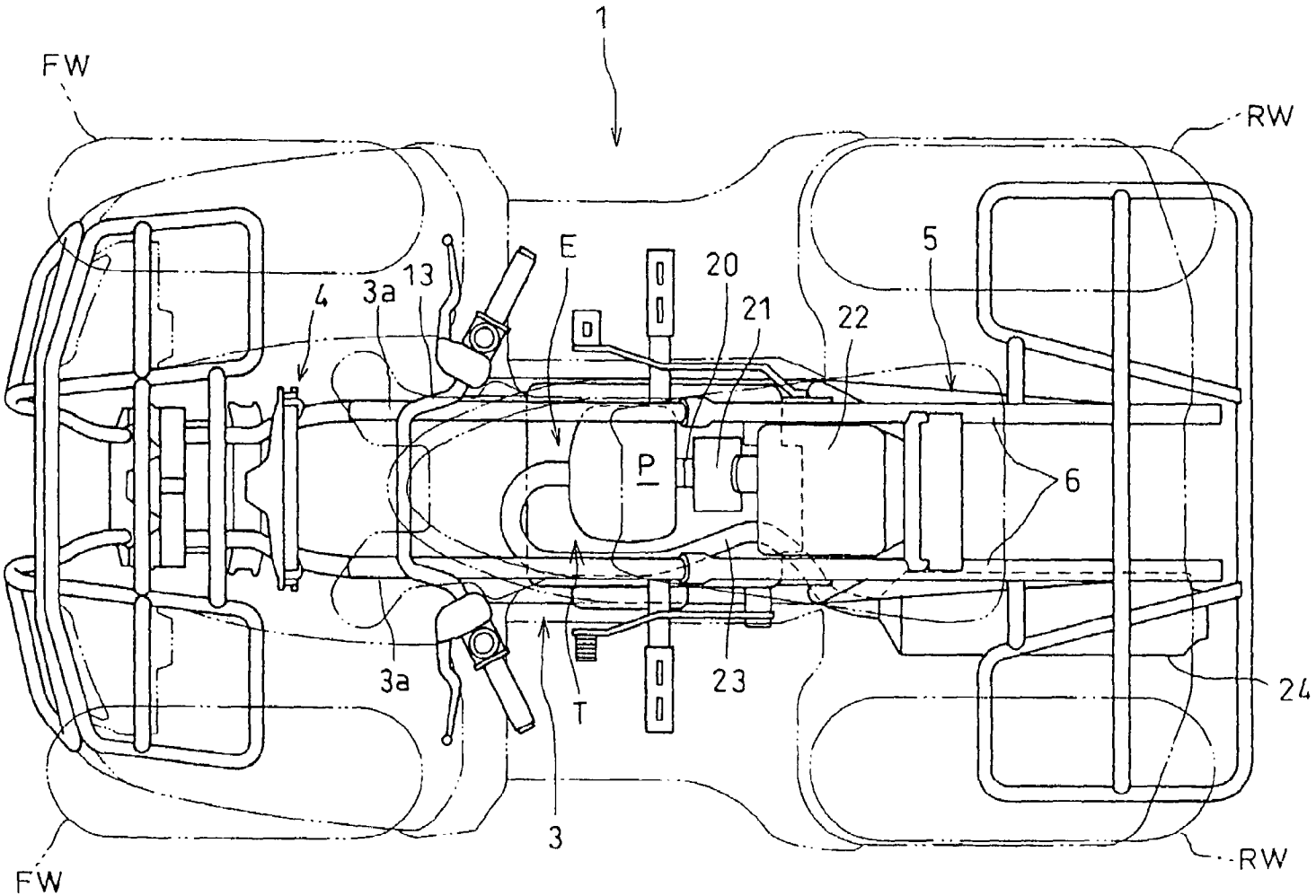
FIG. 2 is a plan view of FIG. 1.

FIGS. 1 and 2 are a side view and a plan view, respectively, illustrating an all terrain vehicle 1 on which a water-cooled internal combustion engine E according to the embodiment is mounted with its body cover and the like removed.

Note that the front, rear or back, left and right are determined based on the vehicle that faces the forward.

The all terrain vehicle 1 is a baggy type four-wheeled vehicle and includes a pair of left and right front wheels FW and a pair of left and right rear wheels RW suspended by the front portion and rear portion, respectively, of a body frame 2. The front and rear wheels each have a low-pressure balloon tire for irregular ground, attached thereto.

The body frame 2 is configured by joining a plurality of types of steel members together and consists of a center frame portion 3, a front frame portion 4 and a rear frame portion 5. The center frame portion 3 mounts thereon a power unit P integrally composed of an internal combustion engine E and a transmission T in a crankcase 31. The front frame portion 4 is joined to the front part of the center frame portion 3 to suspend the front wheels WF. The rear frame portion 5 is joined to the rear part of the center frame portion 3 and includes seat rails 6 supporting a seat 7.

The center frame portion 3 is formed about-rectangular as viewed from the side by bending downwardly a front and a rear part of each of a pair of left and right upper pipes 3*a* to form about three sides and connecting the front part and rear part through the remaining side, i.e., a corresponding one of a pair of left and right lower pipes 3*b*. The left and right pipes are connected by cross members.

A pivot plate 8 is secured to an extension of the rear part of the lower pipe 3*b* that bends obliquely upward. The front end of a swing arm 9 is swingably supported via a shaft by the pivot plate 8. A rear cushion 10 is interposed between the rear part of the swing arm 9 and the rear frame portion 5. The rear wheel RW is suspended by a rear final reduction gear unit 19 provided at the rear end of the swing arm 9.

A steering column 11 is supported by the widthwise center part of a cross member spanned between the front ends of the left and right upper pipes 3*a*. A steering handlebar 13 is joined to the upper end of a steering shaft 12 steerably supported by the steering column 11. The lower end of the steering shaft 12 is connected to a front wheel steering mechanism 14.

The internal combustion engine E of the power unit P is a water-cooled single cylinder internal combustion engine and is mounted on the center frame portion 3 in the so-called longitudinally-mounted posture in which the crankshaft 30 is directed in the back-and-forth direction of the vehicle body.

The transmission T of the power unit P is disposed on the left side of the internal combustion engine E. An output shaft 15 directed in the back-and-forth direction from the transmission T offset leftward projects backward and forward. The rotary power of the output shaft 15 is transmitted from the front end of the output shaft 15 to the left and right front wheels FW via a front drive shaft 16 and a front final rear reduction gear unit 17. Similarly, the rotary power of the output shaft 15 is transmitted from the rear end of the output shaft 15 to the left and right rear wheels RW via the rear drive shaft 18 and the rear final reduction gear unit 19.

The internal combustion engine E rises so as to slightly tilt leftward by placing a cylinder block 32, a cylinder head 33 and a cylinder head cover 34 on the crankcase 31 on this order.

An intake pipe 20 extending rearward from the cylinder head 33 is connected to an air cleaner 22 via a throttle body 21. An exhaust pipe 23 extending forward from the cylinder head 33 bends leftward, extends rearward, passing the left side of the air cleaner 22, and joins to an exhaust muffler 24.

A fuel tank 25 is mounted on the center frame portion 3 of the body frame 2 so as to be located above the power unit 25. A fuel pump 26 is disposed forward of and below the fuel tank 25. A radiator 27 is supported by the front frame portion 4 of the body frame 2.

The crankcase 31 incorporating the internal combustion engine E and transmission T of the power unit T is configured to be divided into a front portion and a rear portion, that is, a front crankcase 31F and a rear crankcase 31R, at a plane orthogonal to the crankshaft 30 passing the central axis of the cylinder bore of the cylinder block 32 and extending in the back-and-forth direction of the vehicle body.

Figure 3:
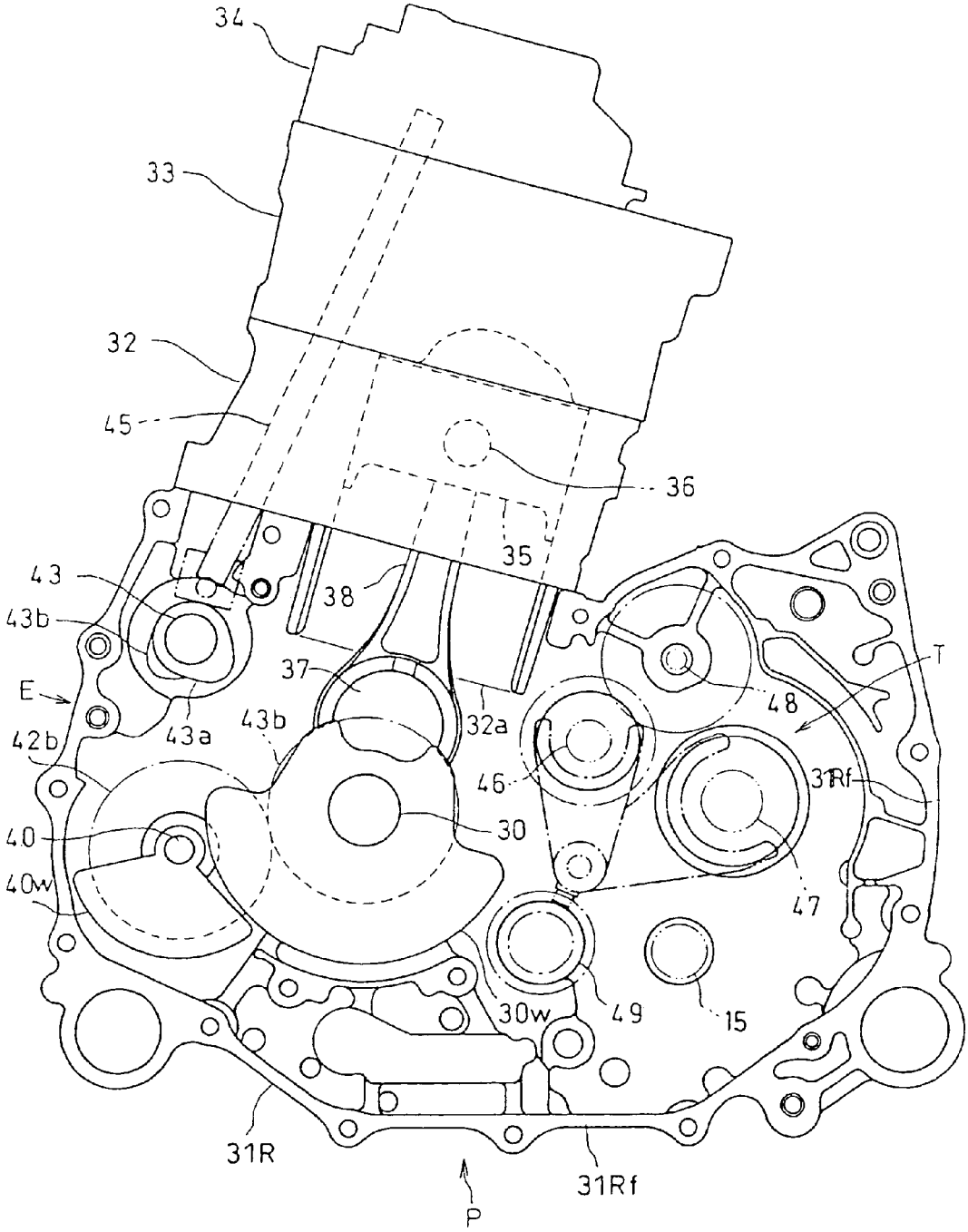
FIG. 3 is a front view of a power unit with the internal combustion engine partially omitted.

FIG. 3 is a front view of the power unit P, illustrating a mating surface 31Rf of the rear crankcase 31 R with the internal combustion engine E partially omitted.

A cylinder sleeve 32*a* is fitted into the crankcase 31 from the cylinder block 32 and a piston 35 is slidably fitted into the cylinder sleeve 32*a*.

A crank pin 37 spanned between a pair of front and rear crank webs 30*w*, 30*w* of the crankshaft 30 is connected to a piston pin 36 attached to the piston 35 by a connecting rod 38.

Figure 4:
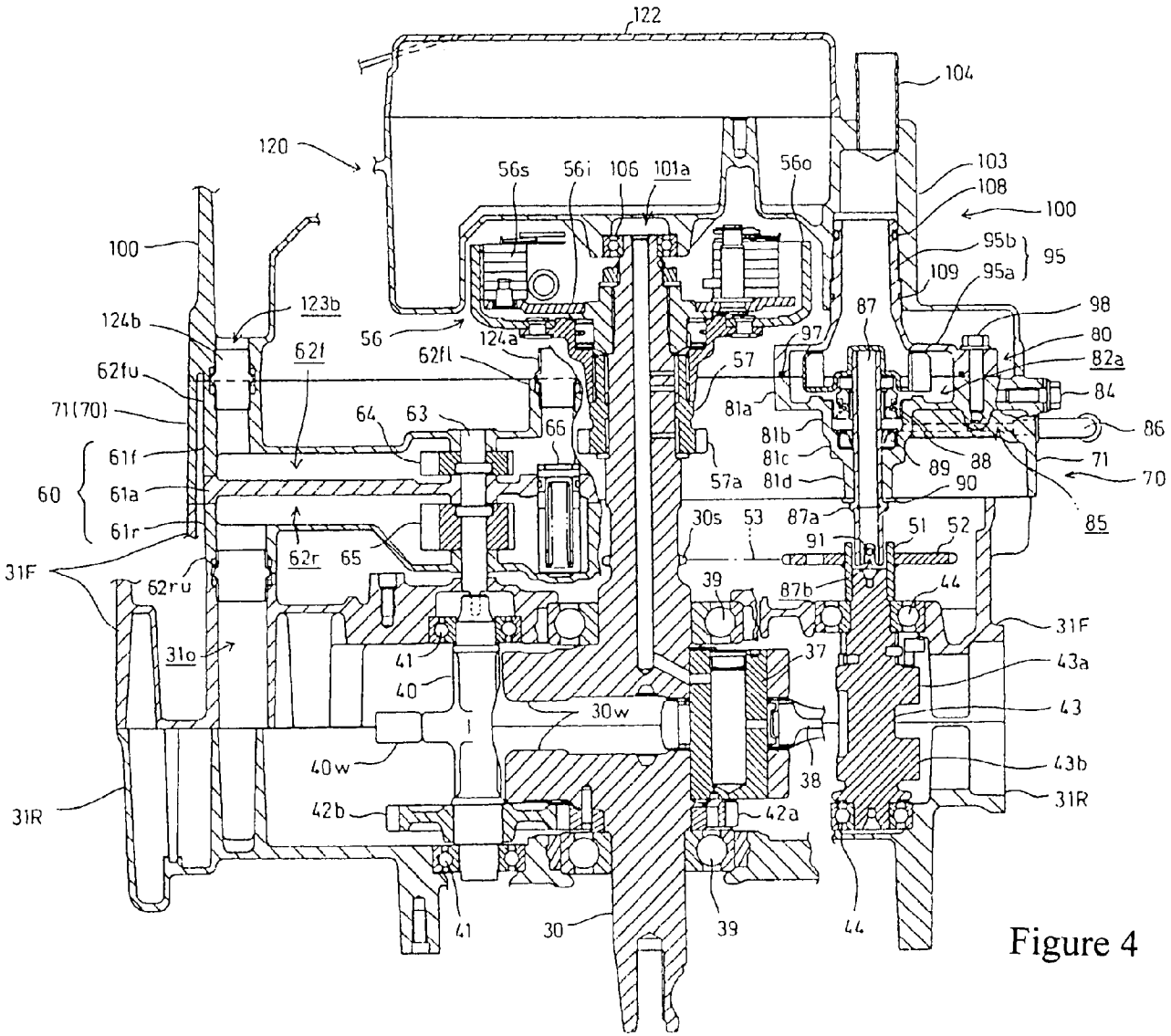
FIG. 4 is a cross-sectional view illustrating an essential portion of the internal combustion engine.

FIG. 4 is a cross-sectional view of an essential part of the internal combustion engine E.

As shown in FIG. 4, the crankshaft 30 is journaled by the front crankcase 31F and the rear crankcase 31R via main bearings 39, 39 in front and rear of the crank webs 30*w*, 30*w*, respectively.

A balancer shaft 40 is disposed on the right of (on the left of, in FIG. 3), slightly below and in parallel to the crankshaft 30. The balancer shaft 40 is journaled at both ends thereof by the front crankcase 31F and the rear front crankcase 31R via bearings 41, 41.

A balancer weight 40*w* is formed at the center of the balancer shaft 40. A driven gear 42*b* is fittingly attached to a rear portion of the balancer weight 40*w* so as to mesh with a drive gear 42*a* fittingly attached to the crankshaft 30 (see FIG. 4).

A valve system cam shaft 43 is disposed on the right of, obliquely above and in parallel to the crankshaft 30. The cam shaft 43 is journaled at both ends thereof by the front crankcase 31F and the rear crankcase 31R via bearings 44, 44.

The lower end of a push rod 45 is in abutment against cam lobs 43*a*, 43*b* of the cam shaft 43 so as to transmit a driving force to a valve mechanism in the cylinder head 33.

On the left of (on the right of, in FIG. 3) the crankshaft 30, is disposed the transmission T in which a main shaft 46, a counter shaft 47 and an intermediate shaft 48 constitute a speed change gear mechanism. Shift transmission is executed by driving a shift drum 49 whereby power is transmitted to the output shaft 15.

Figure 5:
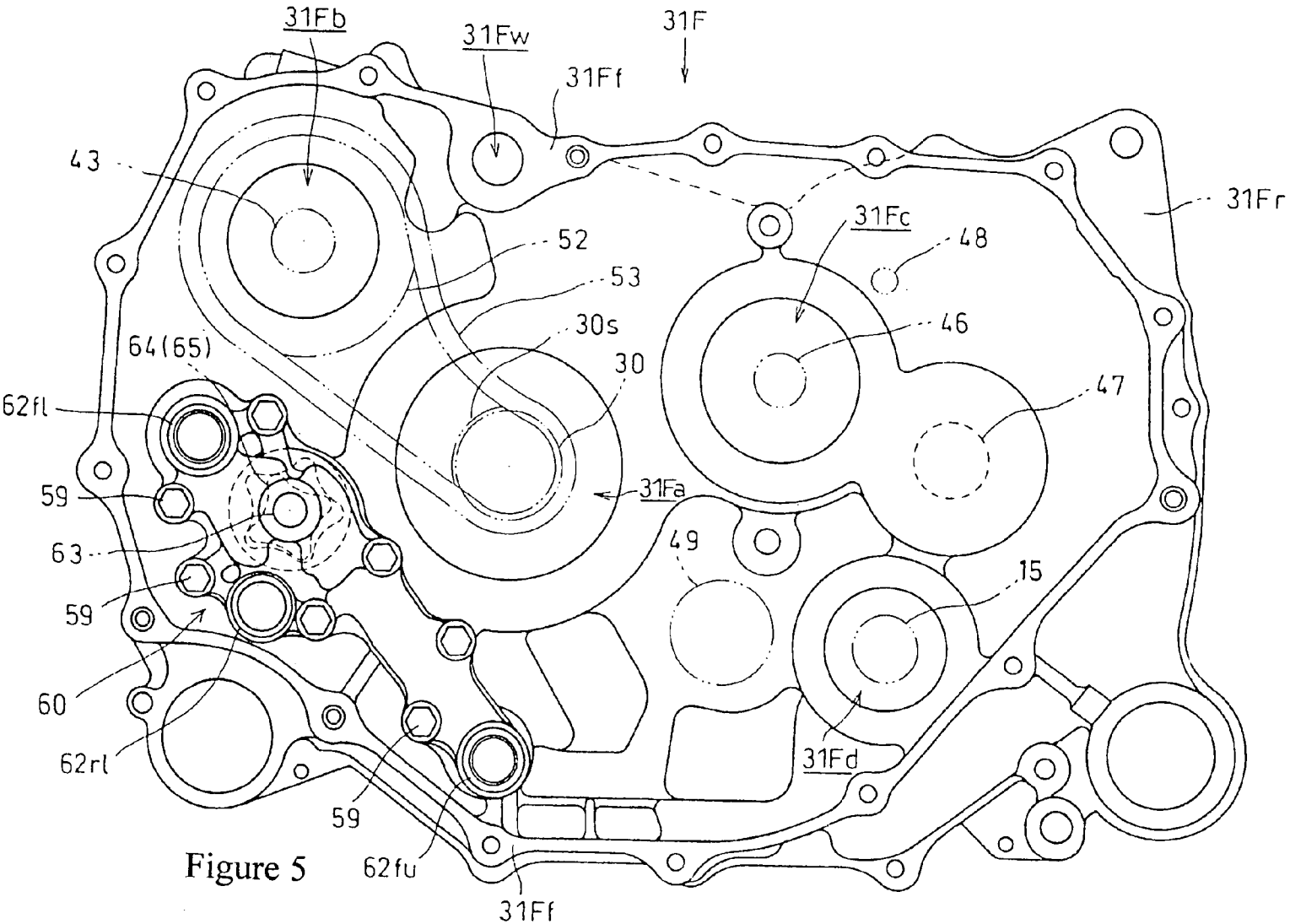
FIG. 5 is a front view of a front crankcase.

A rear side mating surface 31Fr of a front crank case 31F depicted in FIG. 5 is superposed on and fastened to a front side mating surface 31Rf of the rear crankcase 31R depicted in FIG. 3. The crankcase 31 is configured by accommodating therein the crank webs 30*w* of the crankshaft 30, the balancer weight 40*w* of the balancer shaft 40, the cam lobs 43*a*, 43*b* of the camshaft 43 and like and the transmission T.

The front crankcase 31F is formed with: a circular hole 31Fa to which the main bearing 39 is fittingly attached and through which the crankshaft 30 passes; a circular hole 31Fb to which the bearing 44 is fittingly attached and through which the cam shaft 43 passes; a circular hole 31Fc through which the main shaft 46 passes; and a circular hole 31Fd through which the output shaft 15 passes (see FIG. 5).

As shown in FIG. 4, a connection sleeve 51 provided with a driven sprocket 52 is fittingly attached to the front end of the cam shaft 43 which protrudes forwardly from the front crankcase 31F. A chain 53 is spanned between a drive sprocket 30s formed on the crankshaft 30 and the driven sprocket 52 so that rotation of the crankshaft 30 is transmitted to the camshaft 43 via the chain 53 (refer to two-dot chain lines in FIGS. 4 and 5).

On the front side of a portion of the front crankcase 31F adapted to accommodate the balancer shaft 40 therein and below the chain 53, an oil pump unit 60 of a dry sump type lubricating system is internally attached to an annular side wall which forms the front side mating surface 31Ff. FIG. 5 depicts a state in which the oil pump unit 60 is attached.

As shown in the cross-sectional view of FIG. 4, the oil pump unit 60 is configured such that a front oil pump case 61F and a rear oil pump case 61R put a partition wall 61*a* therebetween and oil passages 62*f* and 62*r* are formed in front and rear, respectively, of the partition wall 61*a*. A pump drive shaft 63 passes, in the back-and-forth direction, through the front oil pump case 61F, the partition wall 61*a* and the rear oil pump case 61R and is journaled coaxially with the balancer shaft 40. The rear end of the pump drive shaft 63 further passes through the front crankcase 31F and is coupled to the balancer shaft 40 for integral rotation.

A feed pump 64 and a scavenge pump 65 are provided in the oil passages 62*f* and 62*e* in front and rear, respectively, of the pump drive shaft 63.

In addition, a relief valve 66 capable of communicating with the front and rear oil passages 62*f*, 62*r* is supported by the partition wall 61*a* to pass therethrough.

An upstream inflow nozzle 62*ru* projects rearward of the rear side oil passage 62*r* and is joined to an oil passage 31*o* communicating with a strainer (not shown) provided in the crankcase 31. A downstream side outflow nozzle 62*rl* (see FIG. 5) projecting forward of the oil passage 62*r* communicates with an inflow passage 123*a* (see FIG. 13) of an oil tank 120 formed in a crankcase cover 100 described later.

An upstream side inflow nozzle 62*fu* projecting forward of the front side oil passage 62*f* communicates with an outflow passage 123*b* (see FIG. 13) of the oil tank 120 formed in the crankcase cover 100. Similarly, a downstream side outflow nozzle 62*fl* projecting forwardly communicates with an inflow passages 113*a* (see FIG. 13) of an oil filter 110 formed in the crankcase cover 100.

Thus, when the scavenge pump 65 and the feed pump 64 are rotated together with the pump drive shaft 63 rotating coaxially and integrally with the balancer shaft 40, the scavenge pump 65 sucks in the oil accumulating on the bottom of the crankcase 31 via the strainer and discharges it to the oil tank 120. In addition, the feed pump 64 sucks in the oil from the oil tank 120 and feeds it to every part to be lubricated.

In this way, the oil pump unit 60 and the like are attached to the front side of the front crankcase 31F and the crankcase cover 100 covers the front of the oil pump unit 60 and the like. In addition a spacer 70 is interposed between the front crankcase 31F and the crankcase cover 100.

Figure 6:
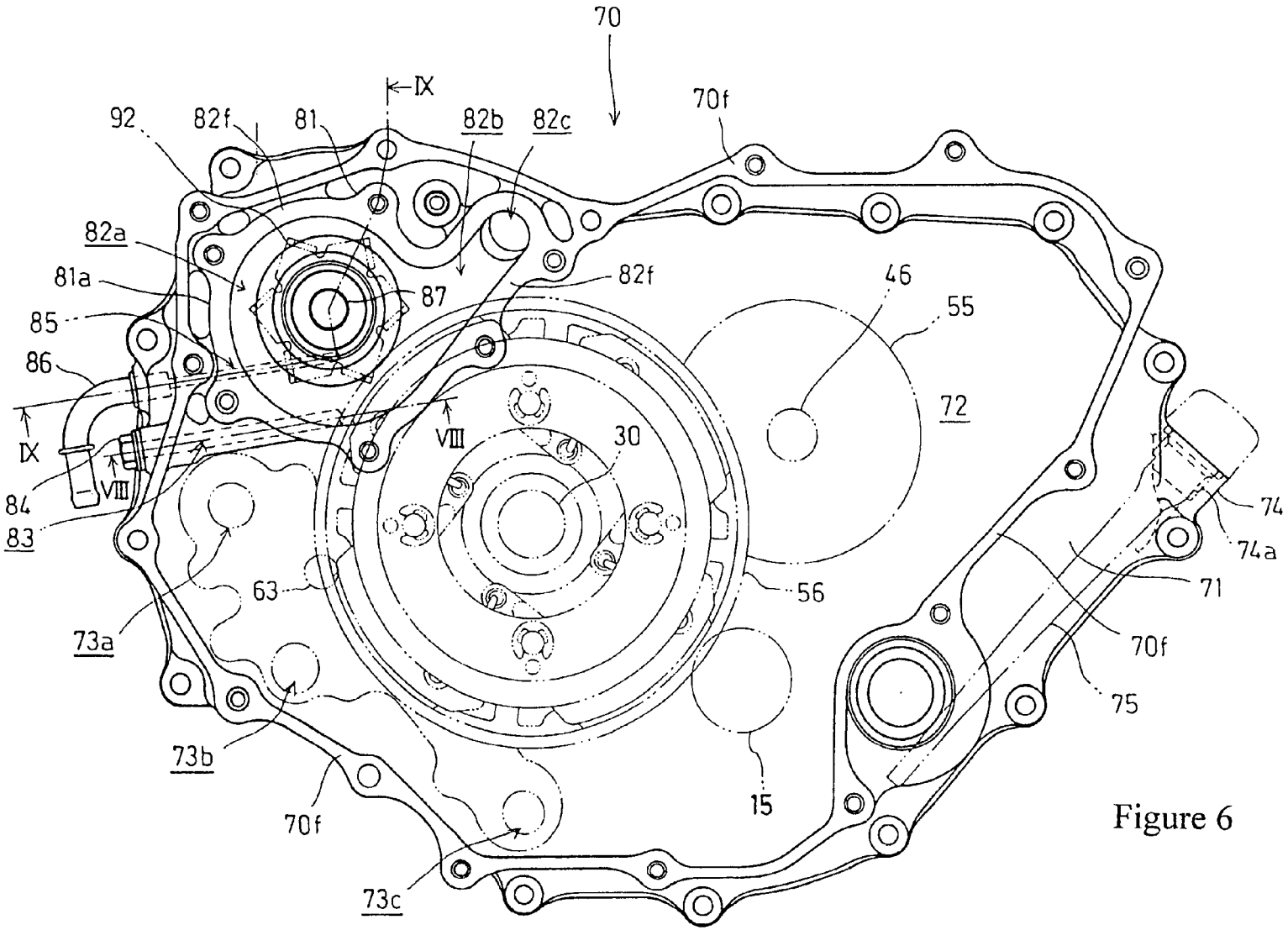
FIG. 6 is a front view of a spacer.

The spacer 70 is adapted to connect the front crankcase 31F and the crankcase cover 100, is formed with front and rear mating surfaces 70*f*, 70*r* parallel to each other and has a substantially constant back-and-forth width. In addition, as shown in FIG. 6, the spacer 70 is an annular member that has a large internal cavity 72 defined by a circumferential wall 71 corresponding to the annular front side mating surface 31Ff of the crankcase 31F. The cavity 72 corresponds to the periphery of the crankshaft 30, the main shaft 46, the output shaft 15 and the like and a region adapted to accommodate the oil pump unit 60 therein.

A water pump body 81 of a water pump 80 is formed to protrude inwardly from the circumferential wall 71 of the spacer 70 at a portion, corresponding to the cam shaft 43, located on the right-hand upper corner of the circumferential wall 71.

Figure 7:
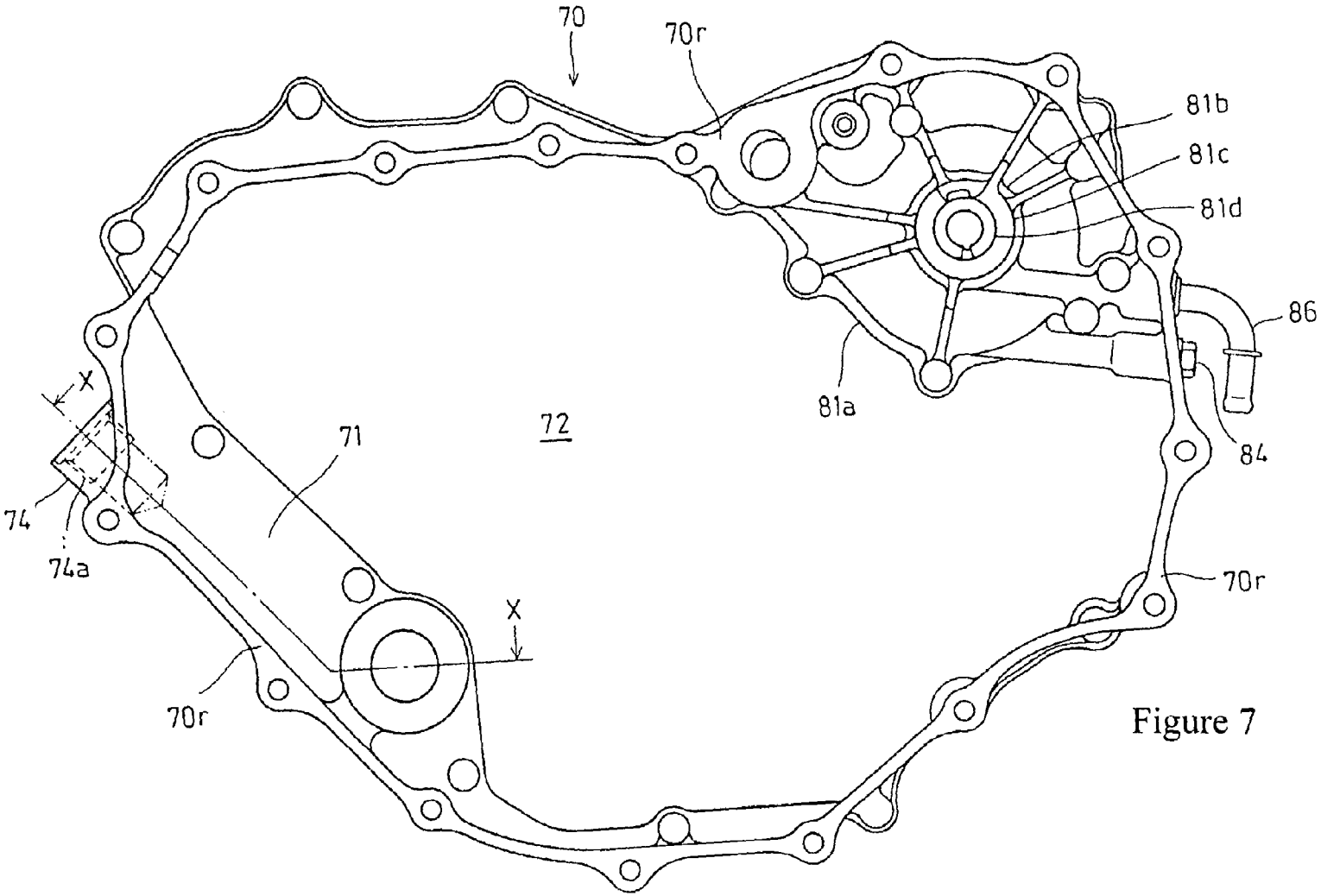
FIG. 7 is a rear view of the spacer.
Figure 10:
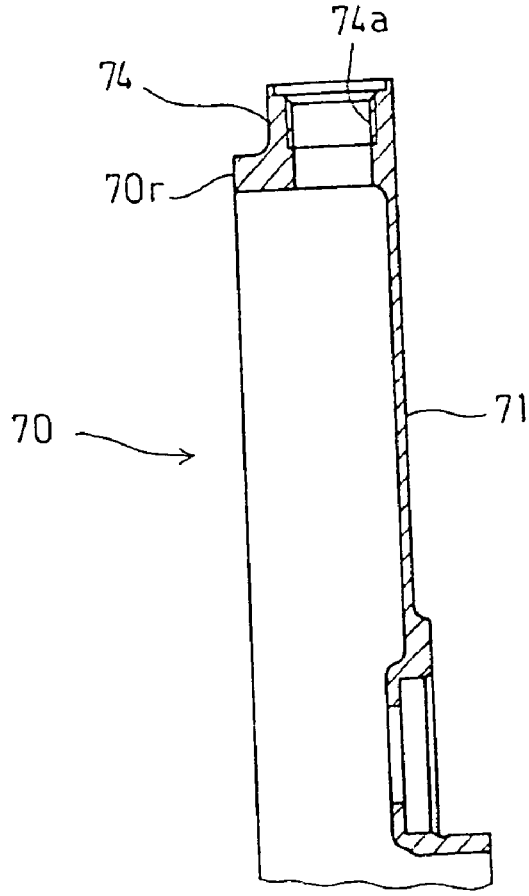
FIG. 10 is a cross-sectional view of the spacer taken along line X-X of FIG. 7.

The water pump body 81 includes a large diameter flat cylindrical part 81*a* opening forwardly and centrally coaxially with the cam shaft 43, a reduced-diameter cylinder part 81*b* rearward thereof, a further-reduced-diameter cylinder part 81*c* and a furthermore-reduced-diameter cylinder part 81*d*, which extend rearward sequentially stepwise (refer to FIGS. 4 and 7).

As shown in FIG. 6, a halved-annular water passage 82*a* is formed inside the large diameter flat cylindrical part 81*a* and part of the halved-annular water passage 82*a* extends tangentially to form a halved-discharge water passage 82*b*. The halved-annular water passage 82*a* and the halved-discharge water passage 82*b* are open forwardly and its opening end face 82*f* is closed-annular and flush with the front mating surface 70*f* of the spacer 70.

A water pump cover 95 is provided with a mating surface having the same shape as that of the opening end face 82*f* as a mating surface and is covered on the opening end face 82 from the forward.

The discharge water passage 82*c* extends rearward from the leading end of the halved-discharge water passage 82*b* and communicates with a discharge water passage 31Fw (see FIG. 5) formed in the front crankcase 31F. Thus, cooling water is supplied from the front crankcase 31F to to-be-cooled portions of the cylinder block 32 and cylinder head 33.

A drain passage 83 is bored to tilt slightly upwardly from the right-hand wall of the spacer 70 toward the lower portion of the halved-annular water passage 82*a*. A drain bolt 84 threads into the outside opening of the drain passage 83 (see FIGS. 6 and 8).

Further, a breather passage 85 is bored from the right-hand wall of the spacer 70 toward the inner lower portion of the cylindrical part 81*b* of the water pump body 81 so as to tilt slightly upwardly in parallel to the drain passage 83. One end of the breather tube 86 is fitted into the outside opening of the breather passage 85 (see FIGS. 6 and 8). The breather tube 86 bends downwardly to direct the opening of the other end thereof toward the downside.

A left-hand portion of the circumferential wall 71 of the spacer 70 is tilted with respect to the axial direction to cover the rearward from the front side. An attachment boss part 74 is formed on the upper portion of the tilted circumferential wall 71 to support an oil level gauge 75 by screwing it into the threaded hole 74*a* thereof (see FIG. 10).

Referring to FIG. 6, the oil level gauge 75 is inserted into the threaded hole 74*a* of the attachment boss part 74 from outside and obliquely above the circumferential wall 71 of the spacer 70. The oil level gauge 75 is attached by engaging the thread formed on the near proximal end thereof with the threaded hole 74*a*. The distal end of the oil level gauge 75 reaches the inner near bottom of the circumferential wall 71 included in the spacer 70 so that it can detect the amount of oil accumulating on the bottom.

As shown in FIG. 4, a cylindrical water pump drive shaft 87 is inserted into the cylindrical parts 81*b*, 81*c*, 81*d* of the water pump body 81 included in the water pump 80. Specifically, this drive shaft 87 is rotatably journaled by the cylindrical part 81. A water seal member 88 is fitted into the inside of the cylindrical part 81*b* and an oil seal member 89 is fitted into the cylindrical part 81*c*, thus providing a dual seal structure.

Incidentally, the breather passage 85 is open between the water seal member 88 inside the cylindrical part 81*d* and the oil seal member 89.

The pump drive shaft 87 is partially formed with a slightly diameter-enlarged protruding part 87*a*. The pump drive shaft 87 is inserted from the rearward of the water pump body 81 to the cylindrical part 81*d* so that the protruding part 87*a* comes into abutment against the rear end face of the cylindrical part 81*d* via a washer 90. This will limit the axially forward movement of the pump drive shaft 87.

The rear end of the pump drive shaft 87 is inserted inside the connection sleeve 51 fixedly secured to the front end of the cam shaft 43 coaxial with the pump drive shaft 87. A pin 91 attached radially to the connection sleeve 51 is fitted into a notch 87*b* formed at the rear end of the pump drive shaft 87. Thus, rotation of the connection sleeve 51 is transmitted to the pump drive shaft 87 via the pin 91.

An impeller 92 is fittingly attached to the front end of the pump drive shaft 87 projecting along the center of the large-diameter flat cylindrical part 81*a* of the water pump body 81. Thus, the halved annular water passage 82*a* of the flat cylindrical part 81*a* is formed around the impeller 92.

A water pump cover 95 is superposed on a front opening defined by the halved annular water passage 82*a* and halved discharge water passage 82*b* of the water pump body 81 so as to cover the impeller 92.

Figure 11:
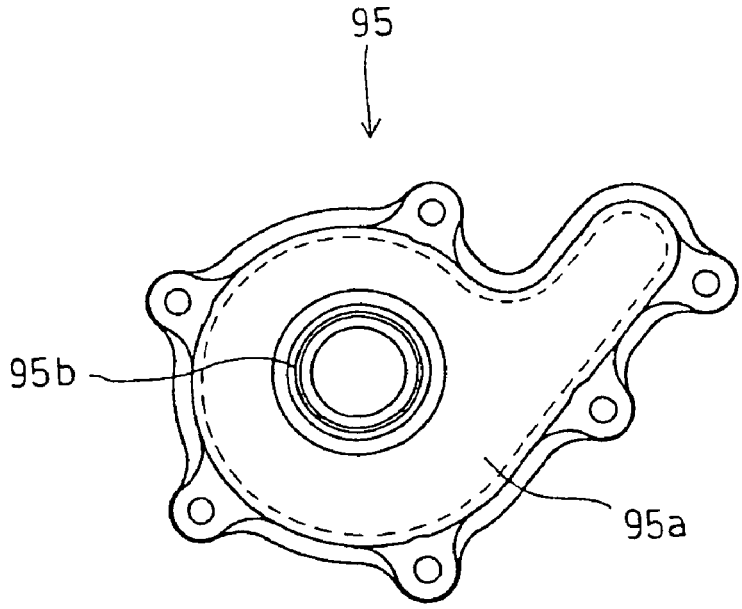
FIG. 11 is a front view of a water pump cover.
Figure 12:
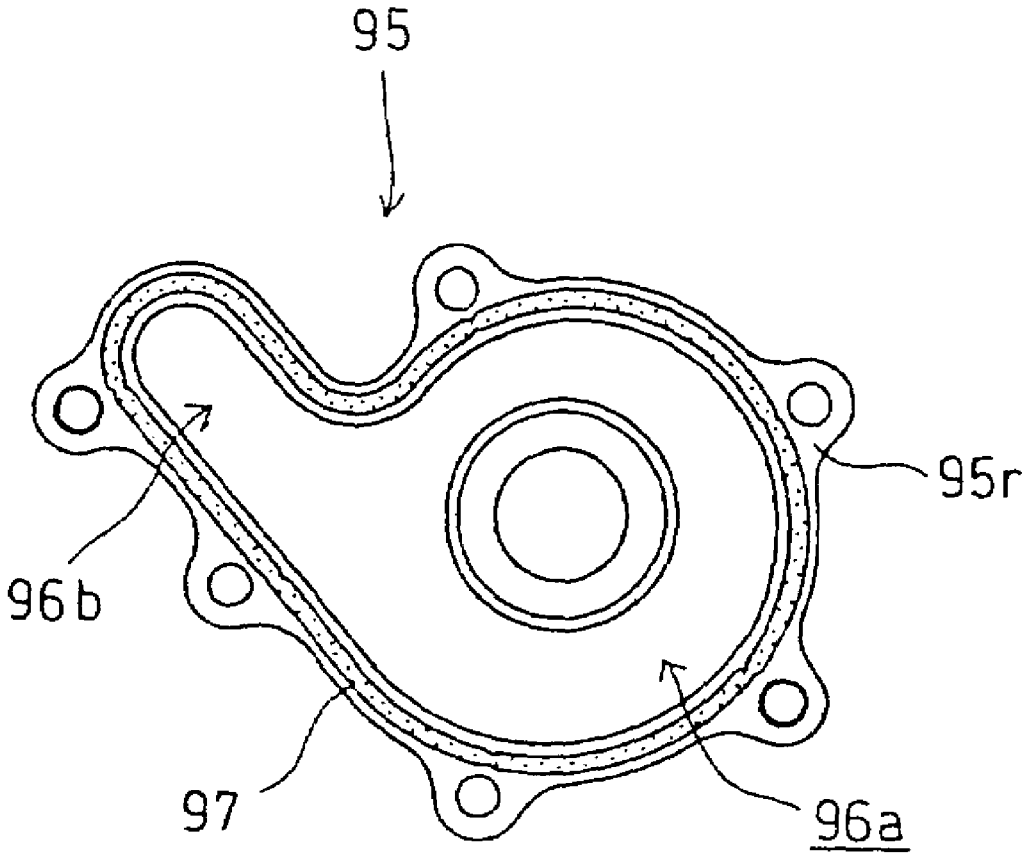
FIG. 12 is a rear view of FIG. 11.
Figure 13:
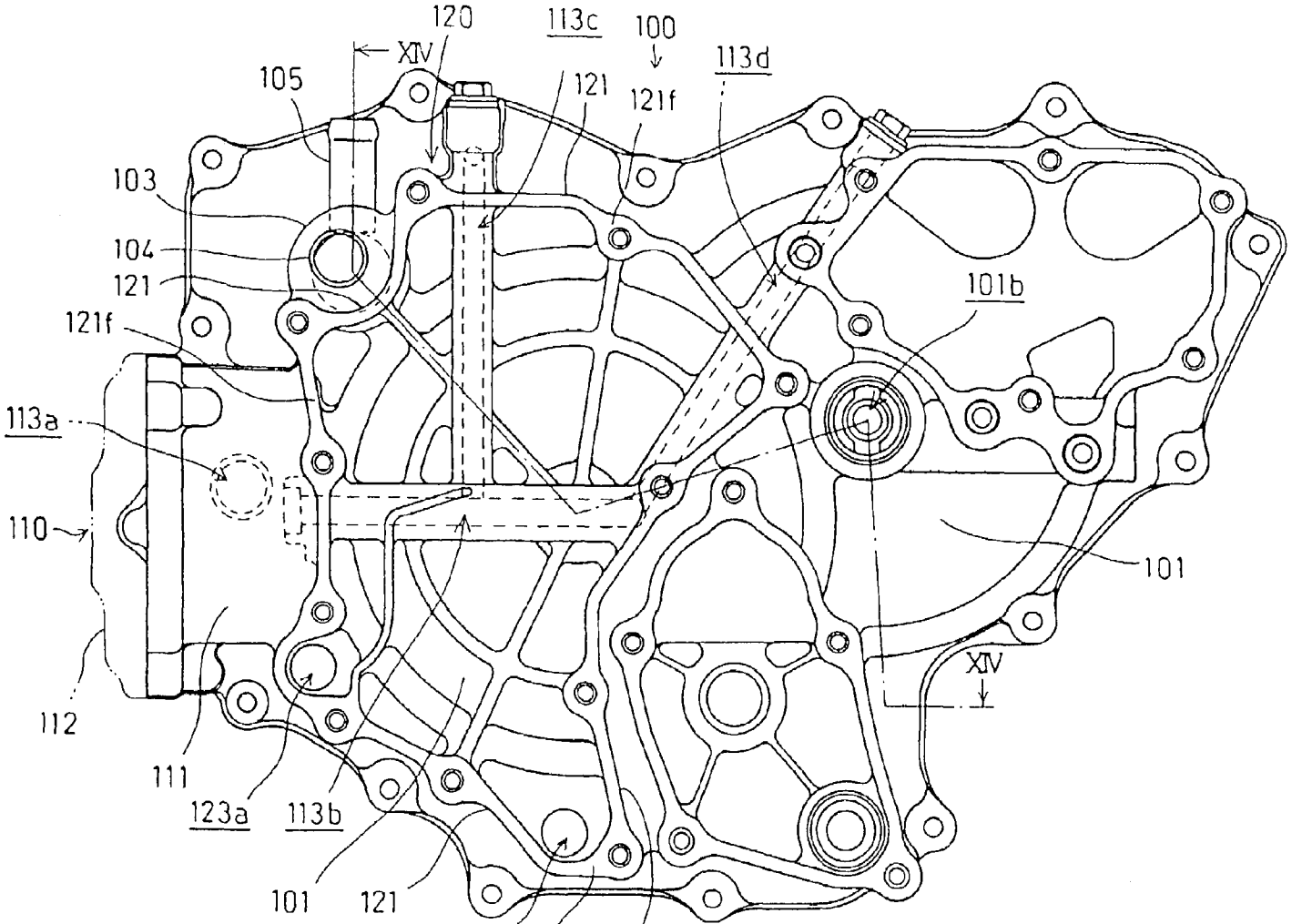
FIG. 13 is a front view of a crankcase cover.

As shown in FIGS. 11 and 12, a cover body portion 95*a* of the water pump cover 95 is formed with: a halved annular water passage 96*a* facing the halved annular water passage 82*a* of the water pump body 81; and a halved discharge water passage 96*b* facing the halved discharge water passage 82*b* of the water pump body 81. In addition, an opening end surface 95*r* opening on the rearward of the halved annular water passage 96*a* and the halved discharge water passage 96*b* faces the opening end surface 82*f* of the water pump body 81. Thus, the opening end face 95*r* and the opening end face 82*f* each serve as a mating surface for the counterpart.

In the water pump cover 95, the bottom wall portion of the halved annular water passage 96*a* included in the cover body portion 95*a* extends toward the center thereof and then its central portion projects forwardly to form a cover cylindrical portion 95*b* or a cooling water sucking nozzle (see FIG. 4).

A seal member 97 is fitted into an annular groove formed in the opening end face 95*r* of the water pump cover 95 (see FIG. 12). When the water pump cover 95 is placed on the water pump body 81 from the front, the opening end face 95*f* of the water pump cover 95 is superposed on the opening end face 82*f* of the water pump body 81 via the seal member 97. Then, the water pump cover 95 is fastened by means of bolts 98.

The center shaft of the cover cylindrical portion 95*b* of the water pump cover 95 is coaxial with the pump drive shaft 87.

When the pump drive shaft 87 is rotated together with the cam shaft 43 and the impeller 92 is rotated, cooling water is sucked from the cover cylindrical portion 95*b* of the water pump cover 95, directed into the annular water passages 82*a*, 96*a* by a centrifugal force and then discharged from the discharge water passages 82*b*, 96*b*.

The water pump 80 is configured such that the water pump body 81 is formed in the spacer 70 and the water pump cover 95 separate from the water pump body 81 protrudes forwardly from the spacer 70.

A shift clutch 55 is provided on a portion of the main shaft 46 that projects forwardly from the front crankcase 31F and that is located in the cavity 72 of the spacer 70. Although the shift clutch 55 extends slightly forwardly from the mating surface 70*f* of the spacer 70, it is generally fitted in the cavity 72 of the spacer 70 (see FIG. 6).

The crankshaft 30 projects forwardly from the front crankcase 31F, passing through the cavity 72 of the spacer 70, and further projects to a position near the front end of the cover cylindrical portion 95*b* of the water cover 95 included in the water pump 80. A centrifugal type start clutch 56, that is power transmission controlling means, is provided on the projection of the crankshaft 30 that is located at a portion roughly corresponding to the cover cylindrical portion 95*b*.

With reference to FIG. 4, the centrifugal type start clutch 56 includes a clutch inner 56*i* or an input member rotated together with the crankshaft 30; a bowlike clutch outer 56*o* or an output member enclosing the clutch inner 56*i* from the radial outside; and a clutch shoe 56*s* or a centrifugal weight that is pivotally supported by the clutch inner 56*i*, is moved radially outwardly by a centrifugal force and comes into contact with the clutch outer 56*o* for engagement. The boss portion of the clutch outer 56*o* is spline fitted to the cylindrical gear member 57 rotatably carried on the clutch shaft 30.

A drive gear 57*a* of the cylindrical gear member 57 meshes with a driven gear (not shown) on the side of the shift clutch 55.

The centrifugal type start clutch 56 is expanded in the radial direction of the crankshaft 30 at a position forward of the front mating surface 70*f* of the spacer 70. The cover body portion 95*a* of the water pump cover 95 and water pump body 81 of the water pump 80 partially overlap the clutch outer 56*o* of the centrifugal type start clutch 56 in the axial direction and are located on the rear side of the clutch outer 56*o* (on the central side of the crankshaft).

That is to say, the water pump 80 is located on the axially inside of the centrifugal type start clutch 56 provided on the front end of the crankshaft 30, i.e., on the central side of the crankshaft 30 and disposed by using the dead space on the axial inside of the centrifugal type start clutch 56. Therefore, the water pump 80 does not project axially outwardly from the centrifugal type start clutch 56. Consequently, the internal combustion engine E can be downsized without increasing the axial width of the entire internal combustion engine E and can be reduced in weight by shortening the length of the pump drive shaft 87 of the water pump 80.

In addition, since the water pump 80 is designed to partially overlap the centrifugal type start clutch 56 in the axial direction, it is disposed to be close to the crankshaft 30, thereby further downsizing the internal combustion engine E.

In this way, the crankcase cover 100 covers, from the front, the centrifugal type start clutch 56 and the water pump cover 95 of the water pump 80 which project forwardly from the front mating surface 70*f* of the spacer 70.

Figure 14:
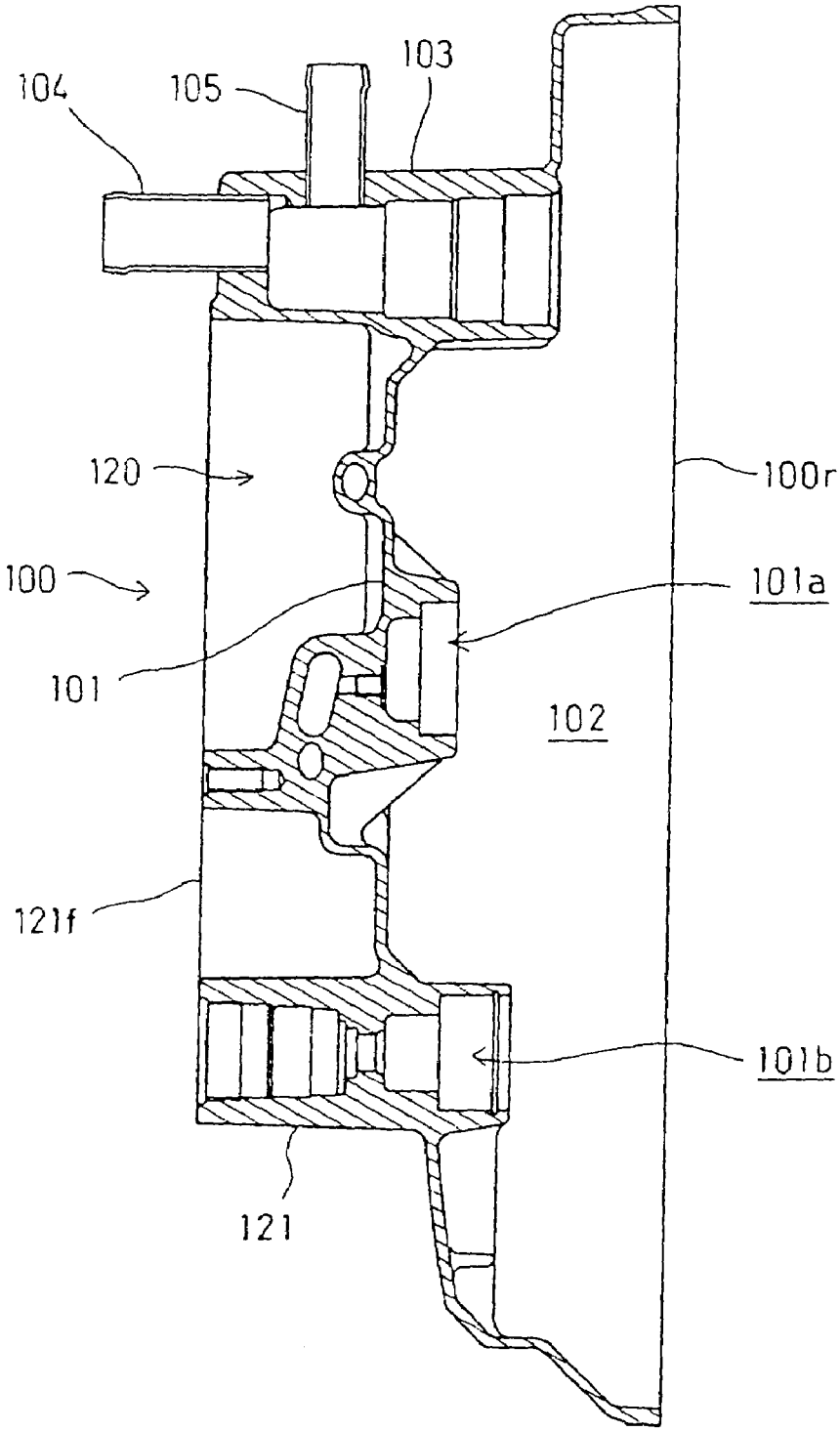
FIG. 14 is a cross-sectional view of the crankcase cover taken along line XIV-XIV of FIG. 13.
Figure 15:
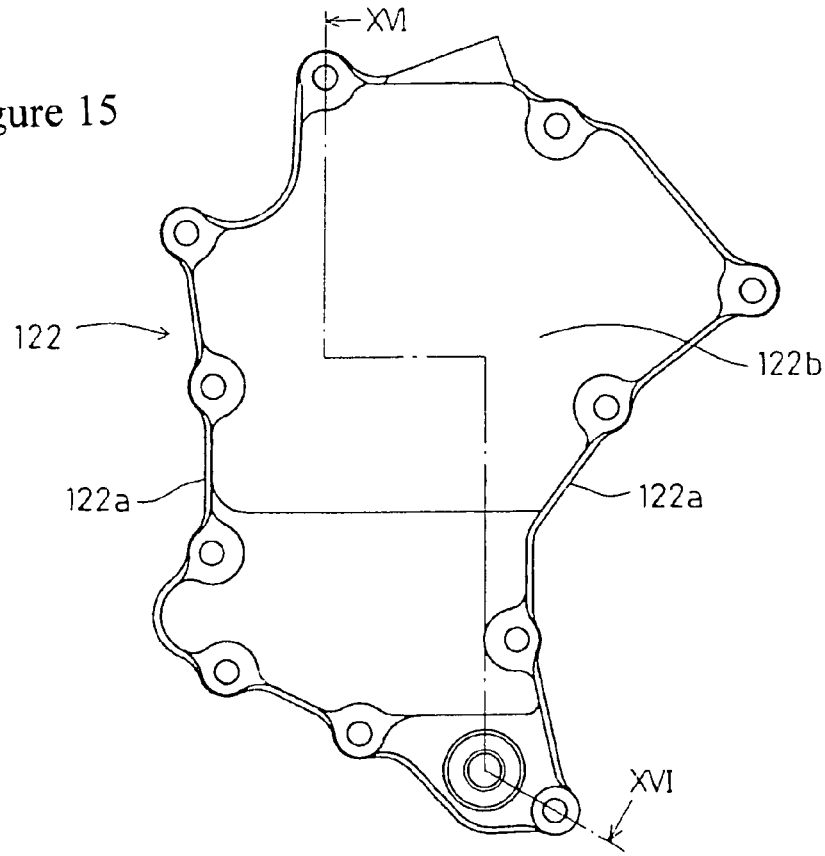
FIG. 15 is a front view of an oil tank cover.
Figure 16:
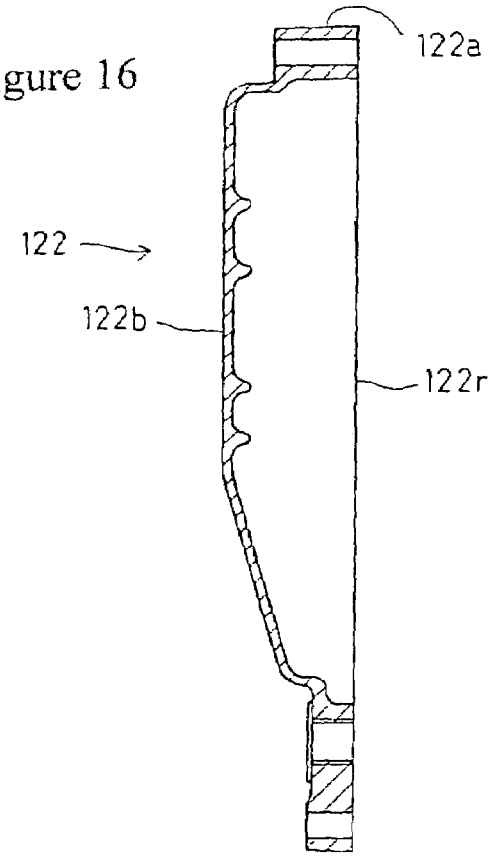
FIG. 16 is a cross-sectional view of the oil tank cover taken along line XVI-XVI of FIG. 15.

The crankcase cover 100 has a mating surface 100*r* corresponding to the front mating surface 70*f* of the spacer 70 and a front wall 101 inside the annular mating surface 100*r* is formed to protrude forwardly (see FIG. 14). The centrifugal type start clutch 56 and the shift clutch 55 is accommodated in this protruding space 102.

As shown in FIG. 14, the front wall 101 is formed with a bearing hole 101*a* adapted to journal the front end of the crankshaft 30 via a bearing 106 and with a bearing hole 101*b* adapted to journal the front end of the main shaft 46 via a bearing (not shown).

The crankcase cover 100 is formed at a portion thereof corresponding to the water pump 80 with a connection cylindrical portion 103 which faces the axial direction so that the cover cylindrical portion 95*b* of the water pump cover 95 can be fittingly inserted into the connection cylindrical portion 103.

The cover cylindrical portion 95*b* of the water pump cover 95 is fitted into the rear half part of the connection cylindrical portion 103 via seal members 108, 109 (see FIG. 4). Connection pipes 104 and 105 are fixedly fitted into the front half portion of the connection cylindrical portion 103 from the front and the side, respectively (see FIGS. 4 and 14).

The connection pipe 104 is attached in a manner not-coaxial with but offset from the central axis of the connection cylindrical portion 130. This is because, when a hose extending from the radiator 27 is coupled to the connection pipe 104, the connection pipe 104 is prevented from interfering with the circumferential wall 122*a* of an oil tank cover 122 described later.

The other connection pipe 105 is coupled to a hose extending from a thermostat (not shown).

Thus, with the switching of the thermostat, cooling water is directly sucked in the water pump 80 from the thermostat not via the radiator 27 during warm-up operation but is sucked via the radiator 27 during the normal operation.

In this way, the water pump 80 is configured such that the cover cylindrical portion 95*b* or a cooling water sucking cylindrical nozzle of the water pump cover 95 is fitted into and fixed to the connection cylindrical portion 103. Therefore, the water pump 80 can be secured to the crankcase cover 100 without use of special members, screws, etc. This reduces the number of part components and provides satisfactory assemble workability.

A filter case 111 of the oil filer 110 is formed on the right-hand wall of the crankcase cover 100, a filter element is inserted into the filter case 111, which is covered by the filter cover 112 from the right, thus constituting the oil filter 110.

The filter case 111 is formed with an inflow passage 113*a* (see FIG. 13) with which the downstream outflow nozzle 62fl of the oil pump unit 60 and a connection pipe 124*a* communicate (see FIG. 4).

The front wall 101 of the crankcase cover 100 is formed with an oil passage 113*b* extending from the middle of the filter case 111 toward a bearing hole 101*a* adapted to journal the front end of the crankshaft 30 via a bearing 106. Oil passages 113*c*, 113*d* are formed to supply oil from the oil passage 113*b* to portions to be lubricated (see FIG. 13).

The internal combustion engine E is of an oil tank integral type. The crankcase cover 100 constitutes part of an oil tank 120. This part is formed of part of the front wall 101 at a position in front of the centrifugal type start clutch 56 so as to be surrounded by the circumferential wall 121.

The opening end face of the circumferential wall 121 is axially vertical and serves as a mating surface 121*f* with the oil tank cover 122. The inflow passage 123*a* and the outflow passage 123*b* are formed in the lower portion of the front wall 101 in the circumferential wall 121. The inflow passage 123*a* communicates with the downstream side outflow nozzle 62*rl* of the oil pump unit 60 via a connection pipe (not shown). The outflow passage 123*b* communicates with the upstream side inflow nozzle 62*fu* of the oil pump unit 60 via a connection pipe 124*b* (see FIG. 4).

The oil tank cover 122 is formed of a circumferential wall 122*a* joined to the circumferential wall 121 of the oil tank 120 formed on the crankcase cover 100 and a front wall 122 covering the inside of the circumferential wall 122*a* so as to be flat bowl-like. The end face of the circumferential wall 122*a* serves as a mating surface 122*r* corresponding to the mating surface 121 f on the side of the crankcase cover 100.

Thus, the oil tank 120 is constructed by abutting the mating surface 122*r* of the oil tank cover 122 against the mating surface 121*f* of the circumferential wall 121 of the crankcase cover 100, fastening them by means of bolts, and joining the circumferential wall 121 with the circumferential wall 122*a*.

As described above, the oil tank 120 can be disposed in the wide space that is located in front of, namely, on the axial outside of the centrifugal type start clutch 56. Therefore, the capacity of the oil tank 120 can be sufficiently ensured while reducing the axially outward expansion of the oil tank cover 122. In addition, in the internal combustion engine E equipped integrally with an oil tank, the entire internal combustion engine E can be downsized, thereby improving its mounting performance on the body frame 2.

The cover cylindrical portion 95*b* protruding forward of the water pump 80 is fitted into and supported by the connection cylindrical portion 103 of the crankcase cover 100 constituting part of the oil tank 120. Therefore, as described above, the water pump 80 can be fastened to the crankcase cover 100 without use of special members, thereby providing satisfactory assembly workability.

The cover cylindrical portion 95*b* or sucking nozzle of the water pump 80 protrudes forwardly to form an opening end at its leading end. In addition, this opening end is located at substantially the same forward position as the front end face of the centrifugal type start clutch 56 provided projectingly in the crankcase cover 100 so as to be spaced apart from the crankcase 31. Accordingly, when the crankcase cover 100 is removed in order to perform maintenance or the like, the crankcase 31 is unlikely to be splashed with water.

In addition, the cover cylindrical portion 95*b* or sucking nozzle of the water pump 80 protrudes to substantially the same forward position as the front end face of the centrifugal type start clutch 56 provided projectingly in the crankcase cover 100 and its front end has an opening. Therefore, the protruding space 102 in the crankcase cover 100 can be effectively utilized without the provision of the special waterproof structure.

In the internal combustion engine E, the crankcase 31 is connected to the crankcase cover 100 through the spacer 70 and the water pump body 81 or part of the water pump 80 is formed integrally with the spacer 70. Accordingly, the crankcase cover 100 can be shared by water-cooled internal combustion engines only by replacing the simply configured spacer 70 without replacement of the crankcase cover having a various functions and being of large size. This makes it easy to change the cooling system and can reduce costs.

The spacer 70 is formed with the water pump body 81 of the water pump 80 and the water pump cover 95 is attached to the water pump body 81. Therefore, even for the relatively large-sized water pump 80, its water pump cover 95 is formed as a separate body on the spacer 70, whereby the spacer 70 can be downsized to facilitate its replacement.

Since the spacer 70 is formed integrally with the drain passage 83, it is not necessary to additionally arrange a pipe adapted to drain water leaking from the water pump 80 to the outside, thereby reducing the number of part components to improve assembly performance and improving the durability of drainage.

The water pump 70 is provided in the vicinity of the circumferential wall 71 of the spacer 70 and the drain passage 83 is formed to connect the water pump 80 with the outer surface of the circumferential wall 71 of the spacer 70. Therefore, the drain passage 83 can be shortened and the cavity 72 inside the circumferential wall 71 of the spacer 70 can be utilized effectively.

Since the breather passage 85 of the water pump 80 is also formed integrally with the spacer 70, it is not necessary to additionally provide a vent pipe adapted to vent air from the water pump 80 to the outside. This further reduces the number of part components to improve assembly performance and improves the durability of the breather.

Since the breather passage 85 is formed to connect the water pump 80 with the outer surface of the circumferential wall 71 of the spacer 70, the breather passage 85 can be shortened and the cavity 72 inside the circumferential wall 71 of the spacer 70 can be utilized effectively.

Incidentally, while the internal combustion engine E is equipped with the centrifugal start clutch 56 at the front end of the crankshaft 30, the present invention is applicable to the engine equipped with a torque converter or other power transmission control means that expands largely in the radial direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water-cooled internal combustion engine in which a crankcase adapted to journal a crankshaft is covered by a crankcase cover from an axial outside, wherein the crankcase is connected to the crankcase cover through a spacer, and at least part of a water pump is formed integrally with the spacer.

2. The water-cooled internal combustion engine according to claim 1, wherein a water pump body of the water pump is formed to be included in the spacer, and a water pump cover is attached to the water pump body.

3. The water-cooled internal combustion engine according to claim 1, wherein a drain passage of the water pump is formed integrally with the spacer.

4. The water-cooled internal combustion engine according to claim 2, wherein a drain passage of the water pump is formed integrally with the spacer.

5. The water-cooled internal combustion engine according to claim 3, wherein the water pump is disposed in the vicinity of an outer circumference of the spacer, and the drain passage is formed to connect the water pump with an outer side surface of the spacer.

6. The water-cooled internal combustion engine according to claim 1, wherein a breather passage of the water pump is formed integrally with the spacer.

7. The water-cooled internal combustion engine according to claim 2, wherein a breather passage of the water pump is formed integrally with the spacer.

8. The water-cooled internal combustion engine according to claim 3, wherein a breather passage of the water pump is formed integrally with the spacer.

9. The water-cooled internal combustion engine according to claim 6, wherein the breather passage is formed to connect the water pump with an outer side surface of the spacer.

10. The water-cooled internal combustion engine according to claim 7, wherein the breather passage is formed to connect the water pump with an outer side surface of the spacer.

11. A water-cooled internal combustion engine, comprising:

a crankcase adapted to journal a crankshaft;

a crankcase cover for covering the crankcase from an axial outside, wherein the crankcase is connected to the crankcase cover through a spacer, and at least part of a water pump is formed integrally with the spacer, the spacer being an annular member.

12. The water-cooled internal combustion engine according to claim 11, wherein a water pump body of the water pump is formed to be included in the spacer, and a water pump cover is attached to the water pump body.

13. The water-cooled internal combustion engine according to claim 11, wherein a drain passage of the water pump is formed integrally with the spacer.

14. The water-cooled internal combustion engine according to claim 13, wherein the water pump is disposed in the vicinity of an outer circumference of the spacer, and the drain passage is formed to connect the water pump with an outer side surface of the spacer.

15. The water-cooled internal combustion engine according to claim 11, wherein a breather passage of the water pump is formed integrally with the spacer.

16. The water-cooled internal combustion engine according to claim 15, wherein the breather passage is formed to connect the water pump with an outer side surface of the spacer.

17. A water-cooled internal combustion engine, comprising:

a crankcase adapted to journal a crankshaft;

a crankcase cover for covering the crankcase from an axial outside, wherein the crankcase is connected to the crankcase cover through a spacer, and at least part of a water pump is formed integrally with the spacer, the spacer having an internal cavity defined by a circumferential wall corresponding to an annular front side mating surface of the crankcase.

18. The water-cooled internal combustion engine according to claim 17, wherein a water pump body of the water pump is formed to be included in the spacer, and a water pump cover is attached to the water pump body.

19. The water-cooled internal combustion engine according to claim 17, wherein a drain passage of the water pump is formed integrally with the spacer.

20. The water-cooled internal combustion engine according to claim 19, wherein the water pump is disposed in the vicinity of an outer circumference of the spacer, and the drain passage is formed to connect the water pump with an outer side surface of the spacer.

* * * * *